United States Patent [19]

Harshberger

[11] 4,338,892

[45] Jul. 13, 1982

[54] INTERNAL COMBUSTION ENGINE WITH SMOOTHED IGNITION

[76] Inventor: Russell P. Harshberger, P.O. Box 601, Pasadena, Calif. 91102

[21] Appl. No.: 133,013

[22] Filed: Mar. 24, 1980

[51] Int. Cl.[3] ..... F02B 75/26

[52] U.S. Cl. ..... 123/54 A; 123/53 A; 123/468

[58] Field of Search ..... 123/54 R, 54 A, 53 R, 123/53 A, 53 B, 456, 468

[56] References Cited

U.S. PATENT DOCUMENTS

| | | | |
|---|---|---|---|
| 2,014,771 | 9/1935 | Mallory | 123/53 B |
| 2,234,267 | 3/1941 | Mallory | 123/53 A |
| 2,392,933 | 1/1946 | Mallory | 123/54 A |

FOREIGN PATENT DOCUMENTS

| | | | |
|---|---|---|---|
| 627780 | 10/1927 | France | 123/53 B |
| 15594 | of 1912 | United Kingdom | 123/294 |

*Primary Examiner*—Craig R. Feinberg
*Attorney, Agent, or Firm*—William W. Haefliger

[57] ABSTRACT

An internal combustion engine has piston means reciprocable in cylinder means, a crankshaft having an axis, and connecting rod structure. Further, the engine is characterized by:

(a) the cylinder means includes two generally side-by-side cylinders, at least one cylinder having an axis out of intersecting alignment with the crankshaft axis, (b) the piston means includes two pistons respectively reciprocable in the two cylinders, (c) the two pistons have connections to the crankshaft via the rod structure, and characterized in that one piston arrives at top dead center position while the other piston is near top dead center position.

1 Claim, 4 Drawing Figures

FIG. 1.
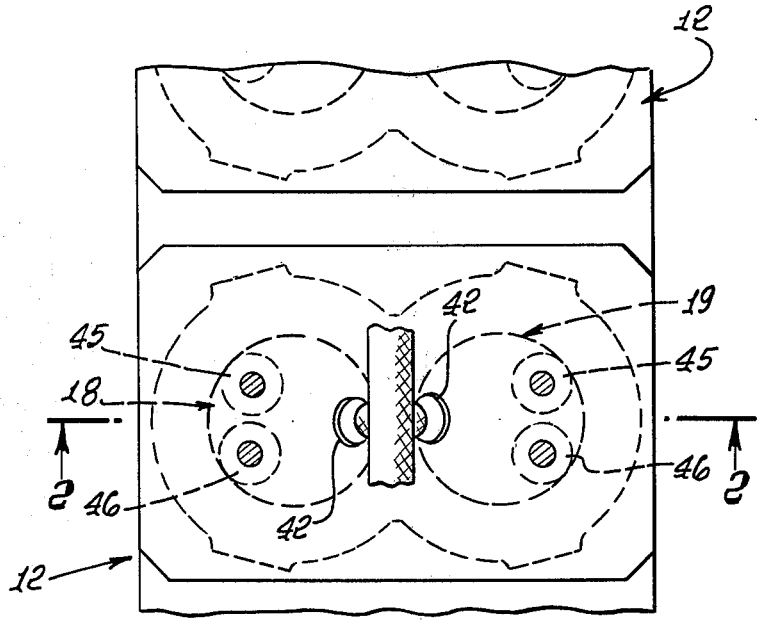
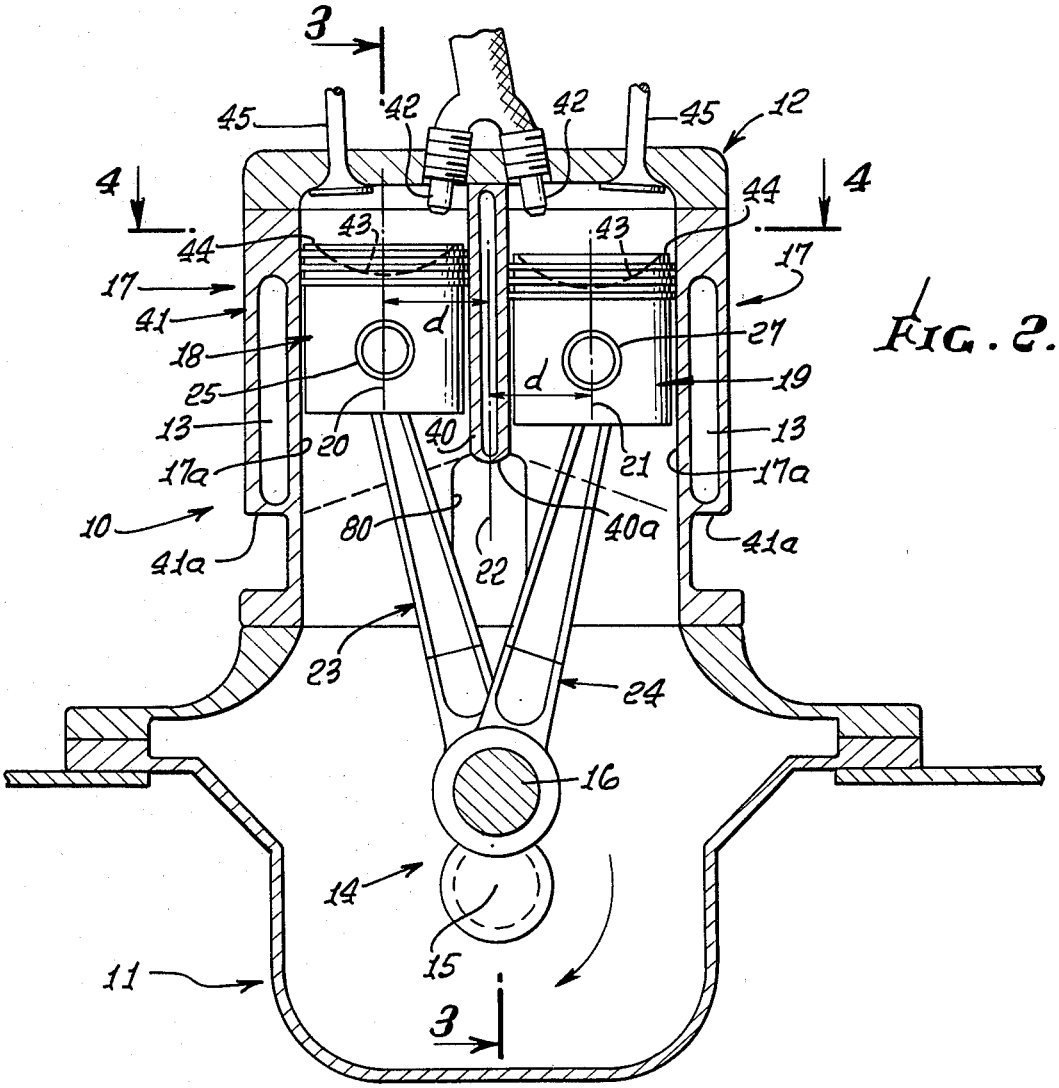
FIG. 2.

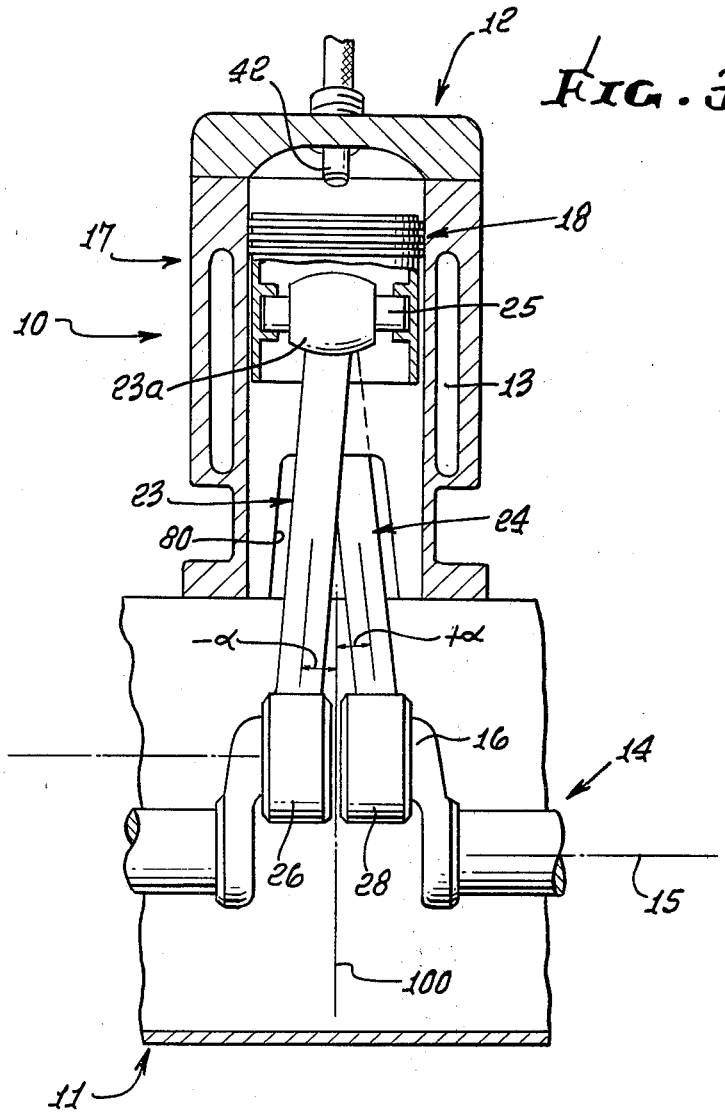
FIG. 3.
FIG. 4.
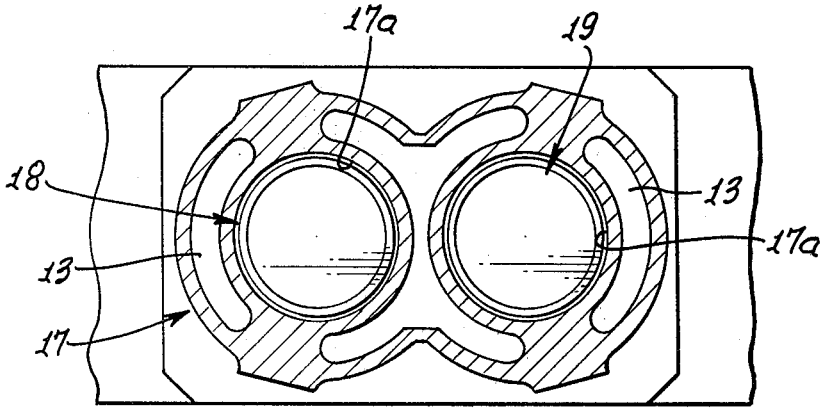

INTERNAL COMBUSTION ENGINE WITH SMOOTHED IGNITION

BACKGROUND OF THE INVENTION

This invention relates generally to internal combustion engines, and more particularly concerns an engine of unusually compact design wherein smooth running is featured.

There is a continuing need for internal combustion engines of compact, smooth running design. Insofar as I am aware, prior engines lack the unusual features of the present invention, which meet the need.

SUMMARY OF THE INVENTION

It is a major object of the invention to provide an internal combustion engine meeting the above need. Basically, it incorporates piston and cylinder means, a crankshaft having an axis, and connecting rod structure, and is characterized by:

(a) said cylinder means including two generally side-by-side cylinders, at least one cylinder having an axis out of intersecting alignment with the crankshaft axis, (b) the piston means including two pistons respectively reciprocable in said two cylinders, (c) the two pistons having connections to said crankshaft via said rod structure characterized in that one piston arrives at top dead center position while the other piston is near the top dead center position.

As will appear, the connecting rods are both connected to the same crankshaft throw; the two cylinder axes define a plane generally normal to the crankshaft axis; the connecting rods extend generally at small angles relative to that plane; and the pistons have cupped heads adjacent a wall separating the two cylinder bores, that wall being shortened to allow connecting rod movement. Accordingly, smooth running is achieved by virtue of two detonations which occur close together, rather than one higher intensity detonation for a cylinder and piston yielding the same torque; and the design is extremely compact.

These and other objects and advantages of the invention, as well as the details of an illustrative embodiment, will be more fully understood from the following description and drawings, in which:

DRAWING DESCRIPTION

FIG. 1 is a top plane view of an engine incorporating the invention;

FIG. 2 is a vertical section taken on lines 2—2 of FIG. 1;

FIG. 3 is a vertical section taken on lines 3—3 of FIG. 2; and

FIG. 4 is a plan view on lines 4—4 of FIG. 2.

DETAILED DESCRIPTION

As shown in the drawings, the Diesel engine includes a block 10, crankcase 11 and head 12, with coolant passages indicated at 13. A crankshaft 14 is rotatable about axis 15, and has an eccentric throw or crank at 16. The block forms cylinder means such as two side-by-side cylinders 17 with bores 17*a*. Piston means such as the two pistons 18 and 19 are reciprocable up and down or axially within the bores.

The cylinder axes are denoted at 20 and 21, it will be noted that at least one of those axes, and typically both, are out of intersecting alignment with the crankshaft axis 15. As shown, each of the axes 20 and 21 is offset a distance "d" from a vertical plane 22 containing the crankshaft axis 15. Also, the two cylinder axes 20 and 21 define a plane 100 which is normal to the axis 15.

The two pistons have connections to the crankshaft via connecting rod structure, as represented by rods 23 and 24. Rod 23 has its upper end 23*a* bearing connected to wrist pin 25 carried by piston 18, and its lower end bearing connected at 26 or crankshaft throw 16. Likewise, rod 24 has its upper end bearing connected to wrist pin 27 carried by piston 19, and its lower end bearing connected at 28 to the same throw 16. The two connections 26 and 28 extend adjacent one another and are aligned along throw axis 29 parallel to axis 15. Note in FIG. 3 that connecting rod 23 extends at a small angle $-\alpha$ relative to plane 100, whereas rod 24 extends at a small angle $+\alpha$ relative to that plane.

It will be noted in FIG. 2 that one piston arrives at top dead center position while the other is near to but approaching top dead center position. This is due to the lateral separation of the two cylinders, as shown. Accordingly, if for example the combustible mixture of air and hydrocarbon is detonated in each cylinder at top dead center position, the two detonations will occur at a slight time separation, providing for smooth running, in a highly compact engine design. For further example, if the two piston do the work of one larger piston, the detonation shock is divided in time and reduced in intensity in each case. Multiple pairs of such cylinders and pistons are shown in FIG. 1, spaced lengthwise of the crankshaft, in FIG. 1.

Also shown in FIG. 2 is a cylinder block wall 40 separating and common to the two cylinders, that wall being locally shortened as via a slot or tunnel 80 of a width and length so as to accommodate travel of the two connecting rods. See for example the upper edge 40*a* of that slot 80 which is above the lower edges 41*a* of outer walls 41.

Further, the engine is shown to incorporate fuel injectors 42 in head 12, directed toward cup-shaped or hemispherical recesses 43 in the piston heads 44. Intake and/or exhaust valves appear at 45 and 56. As shown, the injectors extend into the heads proximate and at opposite sides of wall 40; they receive fuel from a common source, and are arrayed in forked relation above and adjacent to wall 40.

The engine can be of Diesel or spark ignition design.

Typically, one piston arrives at TDC about 20° ahead of the other. Accordingly, the power stroke applied to the one throw is lengthwise to about 200°.

I claim:

1. In an internal combustion engine having piston means reciprocable in cylinder means, a crankshaft having an axis, and connecting rod structure, the improvement comprising (a) said cylinder means including two generally side-by-side cylinders, at least one cylinder having an axis out of intersecting alignment with the crankshaft axis, (b) the piston means including two pistons respectively reciprocable in said two cylinders, (c) the two pistons having connections to said crankshaft via said rod structure characterized in that one piston arrives at top dead center position while the other piston is near top dead center position, (d) the crankshaft having a throw, the connecting rod structure include two connecting rods respectively connected with the two pistons, both said rods connected with said throw, in side-by-side relation, (e) the other cylinder also having an axis out of intersecting alignment with the crankshaft axis, said cylinder axes defining a plane generally normal to the connecting rod axis, (f) one connecting rod extending at a small negative angle relative to said plane, and the other connecting rod extending at a small positive angle relative to said plane, (g) the engine having a common cylinder wall with a section extending between the two cylinders, that wall section containing a slot at the bottom thereof to pass the connecting rods, (h) the cylinders having closed heads and the engine including fuel injectors for Diesel operation, the injectors extending into said heads proximate and at opposite sides of said wall section, to direct injected fuel toward edge portions of cupped heads defined by the pistons, (i) the injectors to receive fuel from a common source, and being arrayed in forked relation above and adjacent to said wall section.

* * * * *